US010383491B2

(12) United States Patent
Xu

(10) Patent No.: US 10,383,491 B2
(45) Date of Patent: Aug. 20, 2019

(54) SITTING TOILET COVER PLATE SUPPORT CAPABLE OF BEING QUICKLY RELEASED AND ASSEMBLED

(71) Applicant: Zhejiang Hengyuan Sanitary Ware Co., Ltd., Linhai, Zhejiang (CN)

(72) Inventor: Xiao Feng Xu, Zhejiang (CN)

(73) Assignee: Zhejiang Hengyuan Sanitary Ware Co., Ltd. (CN)

( * ) Notice: Subject to any disclaimer, the term of this patent is extended or adjusted under 35 U.S.C. 154(b) by 0 days.

(21) Appl. No.: 15/892,131

(22) Filed: Feb. 8, 2018

(65) Prior Publication Data

US 2019/0000285 A1 Jan. 3, 2019

(30) Foreign Application Priority Data

Jul. 3, 2017 (CN) ..... 2017 2 0794659 U

(51) Int. Cl.
*E05D 3/02* (2006.01)
*E05D 7/12* (2006.01)
*A47K 13/12* (2006.01)

(52) U.S. Cl.
CPC ..... *A47K 13/12* (2013.01); *E05D 7/12* (2013.01); *E05D 3/02* (2013.01)

(58) Field of Classification Search
CPC ..... A47K 13/12; E05D 7/12; E05D 3/02
USPC ..... 4/236, 240
See application file for complete search history.

(56) References Cited

U.S. PATENT DOCUMENTS 4,657,458 A * 4/1987 Wollar ..... F16B 37/043 411/182
5,711,645 A * 1/1998 Sanbonmatsu ..... A47K 13/26 411/267
7,203,975 B2 * 4/2007 Vierkant, III ..... A47K 13/26 4/236
8,074,302 B1 * 12/2011 Kook ..... A47K 13/12 4/236
8,763,168 B2 * 7/2014 Zhou ..... A47K 13/26 4/236

* cited by examiner

*Primary Examiner* — Tuan N Nguyen

(57) ABSTRACT

A sitting toilet cover plate support capable of being quickly released and assembled comprising a cover plate support, a rotating shaft, a first hinge, a second hinge, a support cover, a screw rod, a lining ring and an opening nut; an isosceles trapezoid hole is formed in the cover plate support, and a guide groove limiting hole is formed in the top edge of the isosceles trapezoid hole; the rotating shaft is provided with ribs capable of limiting the cover plate support, and an annular groove capable of limiting the hinge is formed in the guide groove limiting hole; the first hinge and the second hinge are respectively arranged on the two sides of the guide groove limiting hole; the first hinge and the second hinge are both 6-shaped hinges.

2 Claims, 6 Drawing Sheets

SITTING TOILET COVER PLATE SUPPORT CAPABLE OF BEING QUICKLY RELEASED AND ASSEMBLED

TECHNICAL FIELD OF THE INVENTION

The present invention relates to the technical field of sanitary products, and more particularly, to a sitting toilet cover plate support capable of being quickly released and assembled.

BACKGROUND OF THE INVENTION

In recent years, toilets have evolved using principles such as siphon, spiral siphon, spray siphon and super-rotation siphon, etc. The sitting toilet can be divided into a split type and an integral type. Along with the development of related technologies, many novel styles have appeared on the market. According to the type of the toilet seat cover, the sitting toilet can be divided into an ordinary toilet and an intelligent toilet. The intelligent toilet can be further divided into an automatic hygienic toilet or a non-automatic hygienic toilet. The automatic hygienic toilet possesses various hi-tech functions such as automatic sanitary-film replacement, automatic washing and drying, etc. The traditional sitting toilet sold on the market basically utilizes a direct-flushing principle or a siphoning principle. A siphoning toilet can be divided into a siphon-vortex type and a siphon-jet type.

The direct-flushing toilet is a toilet that disposes of human waste by using the water flow impulsive force to flush it to another location for disposal. The pool wall of the direct-flushing toilet is usually steep, and the water storage area is small. Therefore, the water power is centralized, the falling water force around the toilet ring is increased, and the flushing efficiency is improved. The direct-flushing toilet has a simple flushing pipeline, a short flushing path and a large pipe diameter (normally 9-10 cm). Thus, the toilet can be thoroughly purged by utilizing the gravitational acceleration of water, and the flushing process is very short. Compared with a siphoning toilet that incorporates a backwater bend, the direct-flushing toilet has a stronger flushing capability so that the human excreta can be easily flushed. Thus, the toilet blockage can be avoided from happening during the flushing process, and it's unnecessary to prepare a wastepaper basket in the bathroom. Furthermore, the direct-flushing toilet can save more water than the siphoning toilet. However, due to the shortcomings such as a large flushing noise and a small water storage area, the direct-flushing toilet is easy to scale and has a poor odor-resistance. In addition, there're very few styles of direct-flushing toilets sold on the market so that the selection range is narrower than that of the siphoning toilet. The drainpipe of the siphoning toilet is configured to be S-shaped, and a certain water level difference can be generated after the drainpipe is fully filled with water. Thus, the human excreta can be easily discharged by utilizing the suction force generated by the flushing water in the drainpipe. As the siphoning toilet does not utilize the water flow impulsion, it has a large water storage area and a small flushing noise. The siphoning toilet can be further divided into a siphon-vortex type and a siphon-jet type.

(1) Siphon-Vortex Toilet

The flushing port of the siphon-vortex toilet is arranged on one side of the toilet bottom. During the flushing process, the water flows along the pool wall to form a vortex, thereby increasing the flushing force of the water flow on the pool wall and the suction force of the siphon action. Thus, the human excreta can be easily discharged.

(2) Siphon-Jet Toilet

The siphon-jet toilet evolved from the siphoning toilet, wherein an auxiliary jet channel is added at the bottom in the toilet, and is aligned to the center of the sewage discharging port. During the flushing process, one part of the water flows out from the water distribution holes in the periphery of the toilet ring, and the other part of the water flows out from the spraying opening. Such a toilet utilizes a larger water flow impulsive force to quickly flush the human waste via the siphon action.

As the water flushing noise is very small, the siphoning toilet is also called a "silent" toilet. To evaluate from the aspect of flushing capability, the human excreta attached to the surface of a toilet bowl can be easily flushed away. Moreover, the siphoning toilet has a larger water storage area and a higher odor-resistance than the direct-flushing toilet. There're various siphoning toilets sold on the market, providing a wide selection range for users.

In order to thoroughly flush the siphoning toilet, water must be filled to a very high water level before flushing. Thus, each flushing process consumes a certain amount of water (at least 8-9 liters), resulting in a huge waste of water. Furthermore, the drainpipe diameter of the siphoning toilet is only about 5-6 cm so that the toilet can be easily blocked during the flushing process. Thus, the wastepaper cannot be directly thrown into the toilet, and the siphoning toilet is usually equipped with a wastepaper basket and a plunger.

Today, the sitting toilet is indispensable. Due to the high use frequency, the sitting toilet, especially the portion where the toilet bowl and the toilet cover plate are connected must be cleaned regularly. Thus, a convenient assembly/release of the toilet cover plate is particularly important for cleaning the sitting toilet. In the prior art, the quick assembling and releasing device of most of the traditional toilet cover plates has a poor locking force and is easier to loose, failing to serve purposes of quick assembling and releasing.

SUMMARY OF THE INVENTION

The purpose of the present invention is to solve the shortcomings in the prior art by providing a sitting toilet cover plate support capable of being quickly released and assembled, which utilizes a locking system composed of a cam and a wedge to achieve a simple and stable cover plate structure that can be easier to assemble and release.

To achieve the above purpose, the present invention adopts the following technical solution:

A sitting toilet cover plate support capable of being quickly released and assembled comprising a cover plate support, a rotating shaft, a first hinge, a second hinge, a support cover, a screw rod, a lining ring and an opening nut; an isosceles trapezoid hole is formed in the cover plate support, and a guide groove limiting hole is formed in the top edge of the isosceles trapezoid hole; the rotating shaft is provided with ribs capable of limiting the cover plate support, and an annular groove capable of limiting the hinge is formed in the guide groove limiting hole; the first hinge and the second hinge are respectively arranged on the two sides of the guide groove limiting hole; the first hinge and the second hinge are both 6-shaped hinges; a limiting hole that allows the rotating shaft to insert is formed in the hinge, and a convex point used for limiting the rotating shaft is arranged in the limiting hole; the rotating shaft connects the first hinge and the second hinge to the two sides of the cover plate support through the guide groove limiting hole; the rotating shaft is a sleeve with limiting ribs capable of limiting the cover plate support, and a pin capable of rotating around the sleeve is arranged on one side of the sleeve; the pin is inserted into the limiting hole of the first hinge, and the sleeve is inserted into the limiting hole of the second hinge.

In another aspect of the present invention, a T-shaped wedge is arranged on the inner side of the support cover, and a small cam is arranged above the T-shaped wedge. A groove matched with the small cam is formed in the cover plate support, and an elastic piece is arranged at the top end of the screw rod. A support surface matched with the isosceles trapezoid hole is arranged on the elastic piece, and an inverted buckle matched with the T-shaped wedge is arranged on the support surface. The opening nut is a triangular shell and is internally provided with a nut structure matched with the screw rod. A lining ring is arranged between opening nut and screw rod.

In another aspect of the present invention, the tail end of the screw rod is an expansion cone structure, and the expansion cone structure comprises a guide section, an expansion section and a sizing section. The lengths of the guide section, the expansion section and the sizing section are respectively defined as $l_1$, $l_2$ and $l_3$. The guide section is used for guiding the expansion section to enter into the sleeve, and the outer diameter $D_1$ of the expansion section is smaller than that of the original diameter d of the opening nut, wherein $D_1<d-0.8$, and the unit of measure is mm. The calculation formula of $l_1$ is $l_1=(0.5\sim0.6)$ d. The calculation relationship between the outer diameter $D_2$ of the expansion section and the opening nut is $D_2=d\ (1.05+\beta)$, wherein $\beta$ represents the expansion rate. The calculation formula of $l_2$ is $l_2=(D2-d)/1.87 \tan \alpha$, wherein $\alpha$ represents the expansion cone angle.

In another aspect of the present invention, the expansion cone angle is 8 degrees.

Compared with the prior art, the present invention has the following advantages:

The cover plate support is provided with a guide groove limiting device. When the rotating shaft is inserted into the cover plate support, the rotating shaft can be directly clamped by the guide groove limiting device instead of a complicated clamping structure. Furthermore, the hinge is provided with a convex point. When the rotating shaft is inserted into the hinge, the convex point on the hinge can be directly clamped into the annular groove of the rotating shaft. Moreover, the support cover is provided with a T-shaped wedge and a small cam. During the process of closing the support cover, the screw rod is simultaneously locked by the small cam and the T-shaped wedge that are arranged on the support cover. Through this double-locking design, a firm and stable structure can be achieved.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

DETAILED DESCRIPTION OF THE INVENTION

Drawings and detailed embodiments are combined hereinafter to elaborate the technical principles of the present invention.

Figure 1:
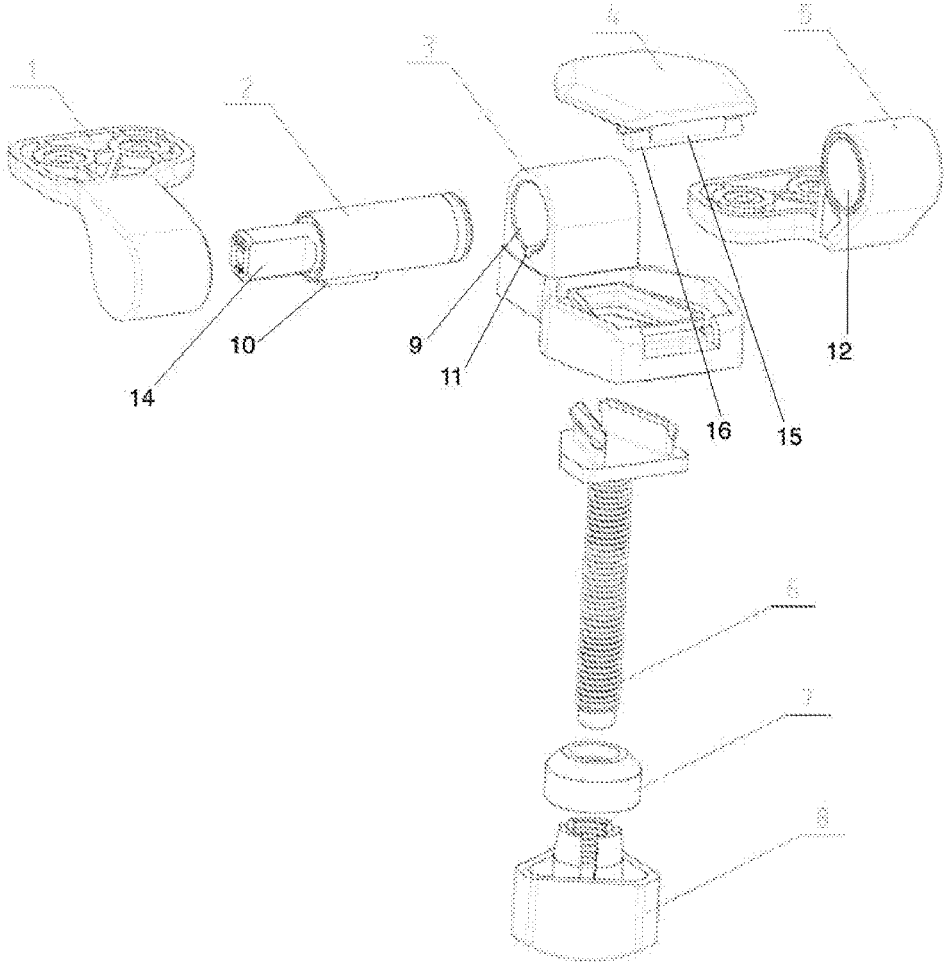
FIG. 1 is an explosive view of the present invention.
Figure 2:
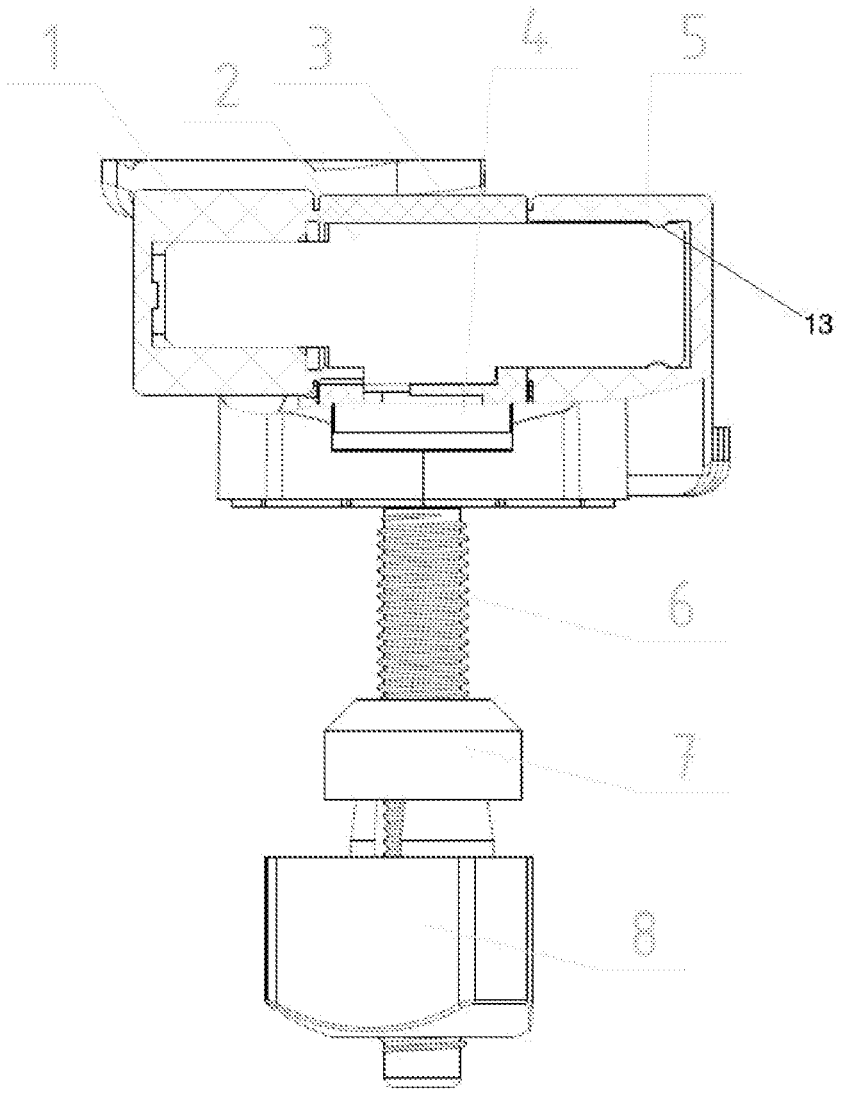
FIG. 2 is a schematic diagram showing the structural assembly of the present invention.
Figure 3:
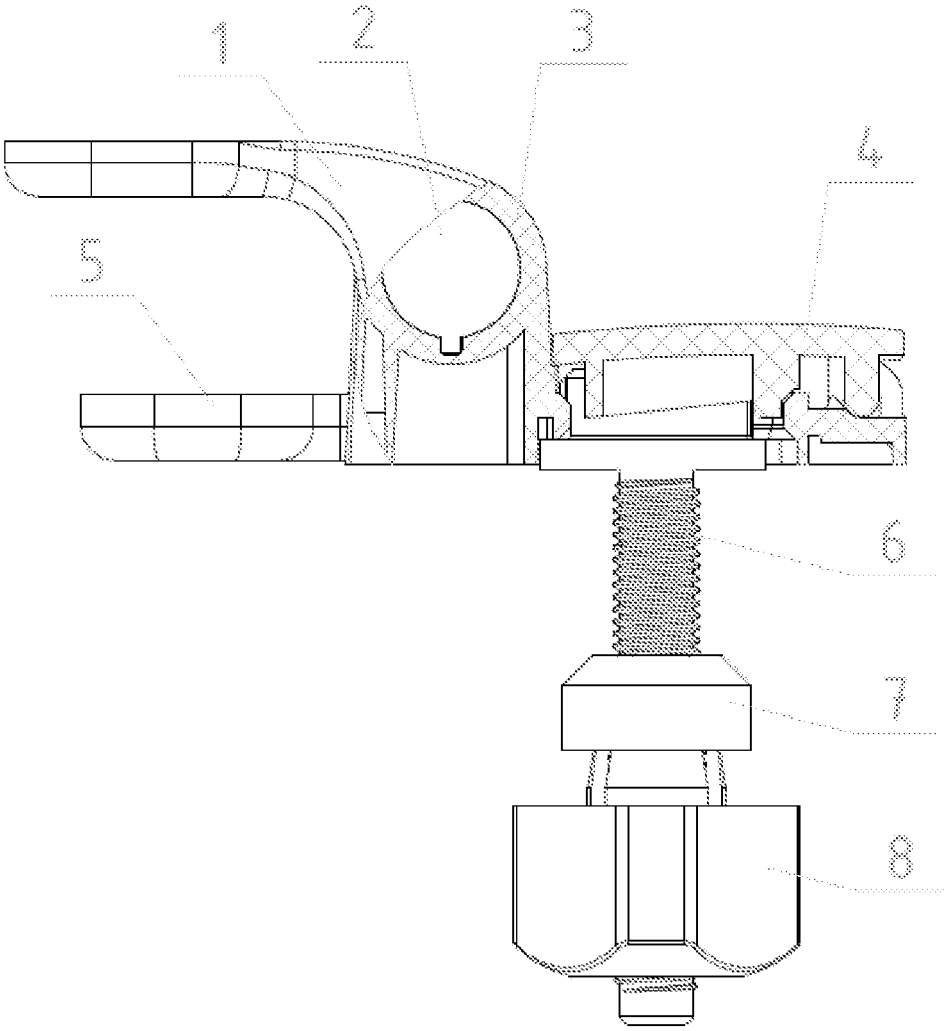
FIG. 3 is a side view showing the structural assembly of the present invention.
Figure 4:
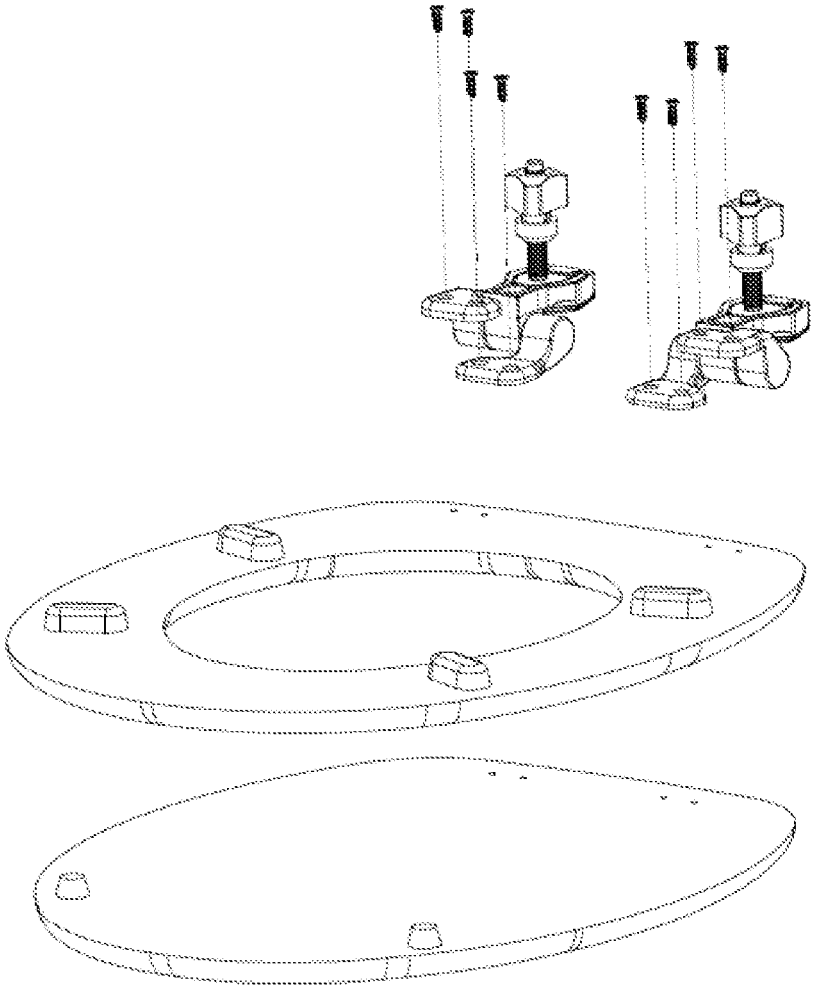
FIG. 4 is a schematic diagram showing the use of the present invention.
Figure 5:
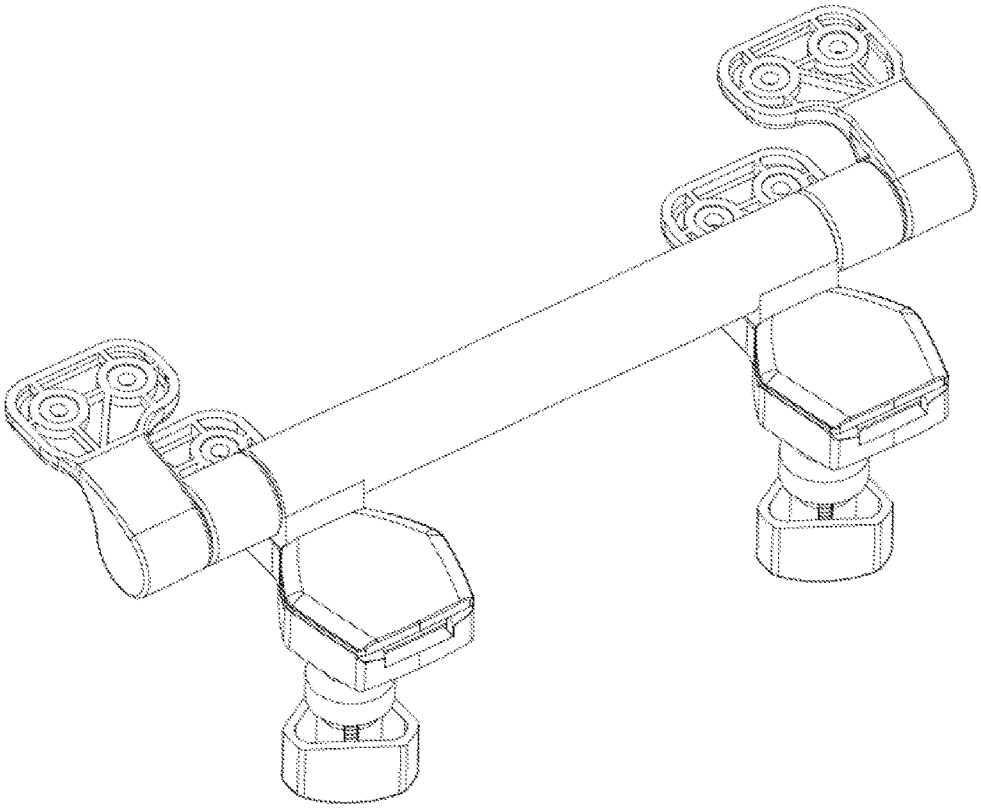
FIG. 5 is a schematic diagram displaying the use of the present invention.
Figure 6:
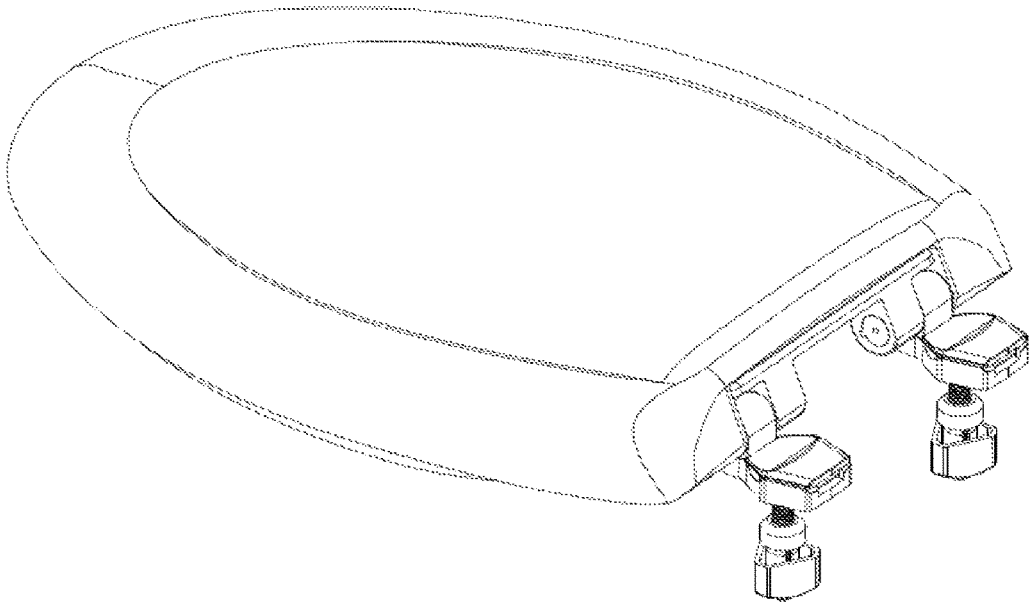
FIG. 6 is a schematic diagram showing the use effect of the present invention.
Figure 7:
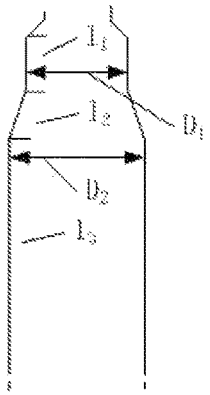
FIG. 7 is a partial structural diagram of the screw rod of the present invention.

As shown in FIGS. 1-7, the sitting toilet cover plate support capable of being quickly released and assembled comprises a cover plate support 3, a rotating shaft 2, a first hinge 1, a second hinge 5, a support cover 4, a screw rod 6, a lining ring 7 and an opening nut 8. An isosceles trapezoid hole is formed in the cover plate support, and a guide groove limiting hole 9 is formed in the top edge of the isosceles trapezoid hole.

The rotating shaft is provided with ribs 10 capable of limiting the cover plate support, and an annular groove 11 capable of limiting the hinge is formed in the guide groove limiting hole. The first hinge and the second hinge are respectively arranged on the two sides of the guide groove limiting hole. The first hinge and the second hinge are both 6-shaped hinges. A limiting hole 12 that allows the rotating shaft to insert is formed in the hinge, and a convex point 13 used for limiting the rotating shaft is arranged in the limiting hole. The rotating shaft connects the first hinge and the second hinge to the two sides of the cover plate support through the guide groove limiting hole. The rotating shaft is a sleeve with limiting ribs capable of limiting the cover plate support, and a pin 14 capable of rotating around the sleeve is arrange on one side of the sleeve. The pin is inserted into the limiting hole of the first hinge, and the sleeve is inserted into the limiting hole of the second hinge.

A T-shaped wedge 15 is arranged on the inner side of the support cover, and a small cam 16 is arranged above the T-shaped wedge. A groove matched with the small cam is formed in the cover plate support, and an elastic piece is arranged at the top end of the screw rod. A support surface matched with the isosceles trapezoid hole is arranged on the elastic piece, and an inverted buckle matched with the T-shaped wedge is arranged on the support surface. The opening nut is a triangular shell and is internally provided with a nut structure matched with the screw rod. A lining ring is arranged between opening nut and screw rod.

The cover plate support is provided with a guide groove limiting device. When the rotating shaft is inserted into the cover plate support, the rotating shaft can be directly clamped by the guide groove limiting device instead of a complicated clamping structure. Furthermore, the hinge is provided with a convex point. When the rotating shaft is inserted into the hinge, the convex point on the hinge can be directly clamped into the annular groove of the rotating shaft. Moreover, the support cover is provided with a T-shaped wedge and a small cam. During the process of closing the support cover, the screw rod is simultaneously locked by the small cam and the T-shaped wedge that are arranged on the support cover. Through this double-locking design, a firm and stable structure can be achieved.

The operating principle of the present invention is the following:

When the rotating shaft is inserted into the cover plate support, the guide groove of the cover plate support is expanded under the compression of the convex rib of the rotating shaft. When the convex rib limiting surface passes through limiting hole of the cover plate support, the guide groove recovers to the original state. Thus, the size of the guide groove is reduced so that the rotating shaft can be clamped. When the second hinge is sleeved with the rotating shaft, the convex point is elastically deformed under the compression of the rotating shaft, and is clamped into the annular groove of the rotating shaft, thereby exerting a limiting function. When the screw rod is inserted into the cover plate support, the screw rod elastic piece is deformed under the compression, and is inserted into the cover plate support. When the support cover is closed, the small cam on the support cover pushes the screw rod elastic piece to lock the screw rod. Meanwhile, the T-shaped wedge on the support cover presses the screw rod elastic piece to lock the screw rod. Thus, the toilet cover can be firmly mounted on the toilet.

Furthermore, when the support cover is opened, the long edge of the screw rod is aligned with the long edge of the cover plate support, and when the cover plate support is pulled upwards, the screw rod elastic piece is deformed under the compression, thereby enabling the cover plate support to be separated from the screw rod. Thus, the toilet cover can be conveniently dismounted from the toilet.

During the process that the rotating shaft is inserted and clamped into the cover plate support, the guide groove is deformed under the compression of the convex rib of the rotating shaft. After the compression force is released, the guide groove recovers to the original state, thereby limiting the convex rib so that the rotating shaft can be limited. During the process that the rotating shaft is inserted and clamped into the hinge, the convex point on the hinge is deformed under the compression of the rotating shaft, and forced to slide into the annular groove on the rotating shaft, thereby limiting the rotating shaft. During the process that the screw rod is inserted and clamped into the cover plate support, the screw rod elastic piece is deformed under the compression of the cover plate support, and is inserted into the cover plate support. When the support cover is closed, the small cam on the support cover pushes the screw rod elastic piece, thereby locking the elastic piece so that the screw rod can be further locked. Meanwhile, the T-shaped wedge on the support cover is inserted into the cover plate support, thereby pressing and locking the elastic piece so that the screw rod can be locked. When the cover plate support is separated from the screw rod, and the support cover is opened, the locking force imposed on the screw rod elastic piece is released. During the process that the cover plate support is pulled out from the screw rod, the screw rod elastic piece is elastically deformed under the compression of the cover plate support, and is separated from the cover plate support. Thus, the cover plate can be conveniently dismounted from the toilet.

The tail end of the screw rod is an expansion cone structure, and the expansion cone structure comprises a guide section, an expansion section and a sizing section. The lengths of the guide section, the expansion section and the sizing section are respectively defined as $l_1$, $l_2$ and $l_3$. The guide section is used for guiding the expansion section to enter into the sleeve, and the outer diameter $D_1$ of the expansion section is smaller than that of the original diameter d of the opening nut, wherein $D_1<d-0.8$, and the unit of measure is mm. The calculation formula of $l_1$ is $l_1=(0.5\sim0.6)d$. The calculation relationship between the outer diameter $D_2$ of the expansion section and the opening nut is $D_2=d(1.05+\beta)$, wherein $\beta$ represents the expansion rate. The calculation formula of $l_2$ is $l_2=(D_2-d)/1.87 \tan \alpha$, wherein $\alpha$ represents the expansion cone angle. This design can achieve a stable connection between the screw rod and the opening nut. Therefore, the screw rod can be protected from being separated from the opening nut, and the toilet body can be prevented from bursting due to excessive expansion of the structure.

Preferably, the expansion cone angle is 8 degrees.

Preferably, the screw rod elastic pieces are arranged in a splayed shape.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A sitting toilet cover plate support capable of being quickly released and assembled, comprising:

a cover plate support;

a rotating shaft;

a first hinge;

a second hinge;

a support cover;

a screw rod;

a lining ring, and an opening nut, wherein an isosceles trapezoid hole is formed in the cover plate support, and a guide groove limiting hole is formed in a top edge of the isosceles trapezoid hole, wherein the rotating shaft is provided with ribs capable of limiting the cover plate support, and an annular groove on two sides of the cover plate capable of limiting the hinges, wherein the first hinge and the second hinge are respectively arranged on the two sides of the guide groove limiting hole, wherein the first hinge and the second hinge are both 6-shaped hinges, wherein a limiting hole that allows the rotating shaft to insert is formed in the first hinge and the second hinge, and a convex point used for limiting the rotating shaft is arranged in the limiting hole of the second hinge, wherein the rotating shaft connects the first hinge and the second hinge to the two sides of the cover plate support through the guide groove limiting hole, wherein the rotating shaft is a sleeve with ribs capable of limiting the cover plate support, and a pin capable of rotating around the sleeve is arrange on one side of the sleeve, wherein the pin is inserted into the limiting hole of the first hinge, and the sleeve is inserted into the limiting hole of the second hinge; wherein a T-shaped wedge is arranged on the inner side of the support cover, and a small cam is arranged above the T-shaped wedge, wherein a groove matched with the small cam is formed in the cover plate support, and an elastic piece is arranged at a top end of the screw rod, wherein a support surface matched with the isosceles trapezoid hole is arranged on the elastic piece, and an inverted buckle matched with the T-shaped wedge is arranged on the support surface, wherein the opening nut is a triangular shell and is internally provided with a nut structure matched with the screw rod, wherein the lining ring is arranged between the opening nut and screw rod, wherein a tail end of the screw rod is an expansion cone structure, and the expansion cone structure comprises a guide section, an expansion section and a sizing section, wherein the lengths of the guide section, the expansion section and the sizing section are respectively defined as $l_1$, $l_2$ and $l_3$, wherein the guide section is used for guiding the expansion section to enter into the sleeve, and the outer diameter $D_1$ of the expansion section is smaller than that of the original diameter d of the opening nut, wherein $D1<d-0.8$, and the unit of measure is mm, wherein the calculation formula of $l_1$ is $l_1=(0.5\sim0.6)\ d$, wherein the calculation relationship between the outer diameter $D_2$ of the expansion section and the opening nut is $D_2=d\ (1.05+\beta)$, and $\beta$ represents the expansion rate, wherein the calculation formula of l2 is $l2=(D2-d)/1.87 \tan \alpha$, and $\alpha$ represents the expansion cone angle.

2. The sitting toilet cover plate support capable of being quickly released and assembled of claim 1, wherein the expansion cone angle is 8 degrees.

* * * * *